US009918507B2

(12) United States Patent
Eaton

(10) Patent No.: US 9,918,507 B2
(45) Date of Patent: Mar. 20, 2018

(54) PROTECTIVE HELMET

(71) Applicant: Charles Eaton, Issaquah, WA (US)

(72) Inventor: Charles Eaton, Issaquah, WA (US)

( * ) Notice: Subject to any disclaimer, the term of this patent is extended or adjusted under 35 U.S.C. 154(b) by 292 days.

(21) Appl. No.: 14/884,404

(22) Filed: Oct. 15, 2015

(65) Prior Publication Data

US 2017/0105470 A1 Apr. 20, 2017

(51) Int. Cl.

| | |
|---|---|
| ***A42B 3/00*** | (2006.01) |
| ***A42B 3/06*** | (2006.01) |
| ***A42B 3/12*** | (2006.01) |

(52) U.S. Cl.

CPC ..... *A42B 3/064* (2013.01); *A42B 3/122* (2013.01)

(58) Field of Classification Search

CPC ..... A42B 3/127; A42B 3/122; A42B 3/00; A42B 3/06; A42B 3/14

See application file for complete search history.

(56) References Cited

U.S. PATENT DOCUMENTS

| | | | | | |
|---|---|---|---|---|---|
| 3,462,763 | A * | 8/1969 | Schneider | A42B 3/12 | 2/413 |
| 3,471,866 | A * | 10/1969 | Raney | A42B 3/14 | 2/418 |
| 3,877,076 | A * | 4/1975 | Summers | A42B 3/065 | 2/414 |
| 4,345,338 | A * | 8/1982 | Frieder, Jr. | A42B 3/124 | 2/414 |
| 2010/0000009 | A1* | 1/2010 | Morgan | A42B 3/124 | 2/414 |
| 2012/0198604 | A1* | 8/2012 | Weber | A42B 3/064 | 2/414 |
| 2013/0185837 | A1* | 7/2013 | Phipps | A42B 3/12 | 2/2.5 |
| 2017/0196293 | A1* | 7/2017 | Podboy | A42B 3/122 | |

* cited by examiner

*Primary Examiner* — Tejash Patel

(74) *Attorney, Agent, or Firm* — Christensen O'Connor Johnson Kindness PLLC

(57) ABSTRACT

A protective helmet includes a primary inner shell, a first outer impact shell, and a second outer impact shell. The primary inner shell is configured to be worn on a user's head and the primary inner shell comprises a crown portion and a rear portion. The first outer impact shell is located above the crown portion and the second outer impact shell is located above the rear portion. Each of the first and second outer impact shells has a first end and a second end. The first end is hingedly secured to the primary inner shell and the second end is coupled to the primary inner shell by at least one shock absorber. The at least one first shock absorber is configured to resist rotational movement of the first and second outer impact shells toward the crown and rear portions of the primary inner shell.

21 Claims, 18 Drawing Sheets

PROTECTIVE HELMET

CROSS-REFERENCE TO RELATED APPLICATION

This application claims the benefit of U.S. Provisional Patent Application No. 62/804,323, filed Nov. 25, 2014, the disclosure of which is incorporated herein by reference in its entirety.

BACKGROUND

Many activities require protective gear for a person's head. Some of these activities include sporting activities, such as football and baseball, high adventure activities, such as rock climbing and white water rafting and kayaking, work activities, such as in construction areas, and many more. Increasing protection of the wearer's head can reduce the risk of head and neck injuries, such as concussions.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a helmet includes a primary inner shell, a first outer impact shell, and a second outer impact shell. The primary inner shell is configured to be worn on a user's head and the primary inner shell includes a crown portion and a rear portion. The first outer impact shell has a first end and a second end. The first end of the first outer impact shell is hingedly secured to the primary inner shell. The second end of the first outer impact shell is coupled to the primary inner shell by at least one first shock absorber. The first outer impact shell is located above the crown portion of the primary inner shell. The at least one first shock absorber is configured to resist rotational movement of the first outer impact shell toward the crown portion of the primary inner shell. The second outer impact shell has a first end and a second end. The first end of the second outer impact shell is hingedly secured to the primary inner shell. The second end of the second outer impact shell is coupled to the primary inner shell by at least one second shock absorber. The second outer impact shell is located above the rear portion of the primary inner shell. The at least one second shock absorber is configured to resist rotational movement of the second outer impact shell toward the rear portion of the primary inner shell.

In one example, the at least one first shock absorber includes two piston and cylinder shock absorbers, where each of the two piston and cylinder shock absorbers is fastened to the second end of the first outer impact shell, passes through the primary inner shell, and is fastened to an inner side of the primary inner shell. In another example, the at least one second shock absorber includes two piston and cylinder shock absorbers, where each of the two piston and cylinder shock absorbers is fastened to the second end of the second outer impact shell, passes through the primary inner shell, and is fastened to an inner side of the primary inner shell.

In another example, the at least one first shock absorber includes at least one compression spring located between an outer side of the primary inner shell and the first outer impact shell. In another example, the at least one first shock absorber includes at least one leaf spring located between an outer side of the primary inner shell and the first outer impact shell. In another example, the at least one first shock absorber includes at least one low profile piston and cylinder located between an outer side of the primary inner shell and the first outer impact shell.

In another example, the first end of the first outer impact shell is hingedly secured to the primary inner shell via a first rotational mount, and wherein the first end of the second outer impact shell is hingedly secured to the primary inner shell via a second rotational mount. In another example, the first and second rotational mounts are parallel to each other and tangential to the primary inner shell.

In another example, the first outer impact shell is located in a depressed crown portion of the primary inner shell and the second outer impact shell is located in a depressed rear portion of the primary inner shell. In another example, the helmet has a smooth contour between the first and second outer impact shells and the portions of the primary inner shell other than the depressed crown portion and the depressed rear portion. In another example, at least one of the first and second outer impact shells is hingedly secured to the primary inner shell via an axle rotational mount. In another example, at least one of the first and second outer impact shells is hingedly secured to the primary inner shell via a removable rotational mount. In another example, the first and second outer impact shells are configured to rotate independently of each other.

In another embodiment, a helmet includes a primary inner shell, an outer impact shell, and at least one shock absorber. The primary inner shell is configured to be worn on a user's head and the primary inner shell includes a depressed crown portion. The outer impact shell is located in the depressed crown portion of the primary inner shell. The outer impact shell has a first end and a second end. The first end of the outer impact shell being hingedly secured to the primary inner shell. The at least one shock absorber is coupled to the second end of the outer impact shell and to the primary inner shell. The at least one shock absorber is configured to resist rotational movement of the outer impact shell toward the crown portion of the primary inner shell. The helmet has a smooth contour between the outer impact shell and the portions of the primary inner shell other than the depressed crown portion.

In one example, the at least one first shock absorber includes two shock absorbers. In another example, the two shock absorbers are piston and cylinder shock absorbers and each of the two piston and cylinder shock absorbers is fastened to the second end of the outer impact shell, passes through the primary inner shell, and is fastened to an inner side of the primary inner shell. In another example, the at least one first shock absorber includes one or more of a compression spring shock absorber located between an outer side of the primary inner shell and the outer impact shell, a leaf spring shock absorber located between an outer side of the primary inner shell and the outer impact shell, or a low profile piston and cylinder located between an outer side of the primary inner shell and the outer impact shell.

In another embodiment, a helmet includes a primary inner shell, an outer impact shell, and at least one shock absorber. The primary inner shell is configured to be worn on a user's head and the primary inner shell includes a depressed rear portion. The outer impact shell is located in the depressed rear portion of the primary inner shell. The outer impact shell has a first end and a second end. The first end of the outer impact shell being hingedly secured to the primary inner shell. The at least one shock absorber is coupled to the second end of the outer impact shell and to the primary inner shell. The at least one shock absorber is configured to resist rotational movement of the outer impact shell toward the rear portion of the primary inner shell. The helmet has a smooth contour between the outer impact shell and the portions of the primary inner shell other than the depressed rear portion.

In one example, the at least one first shock absorber includes two shock absorbers. In another example, the two shock absorbers are piston and cylinder shock absorbers and each of the two piston and cylinder shock absorbers is fastened to the second end of the outer impact shell, passes through the primary inner shell, and is fastened to an inner side of the primary inner shell.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

Figure 1:
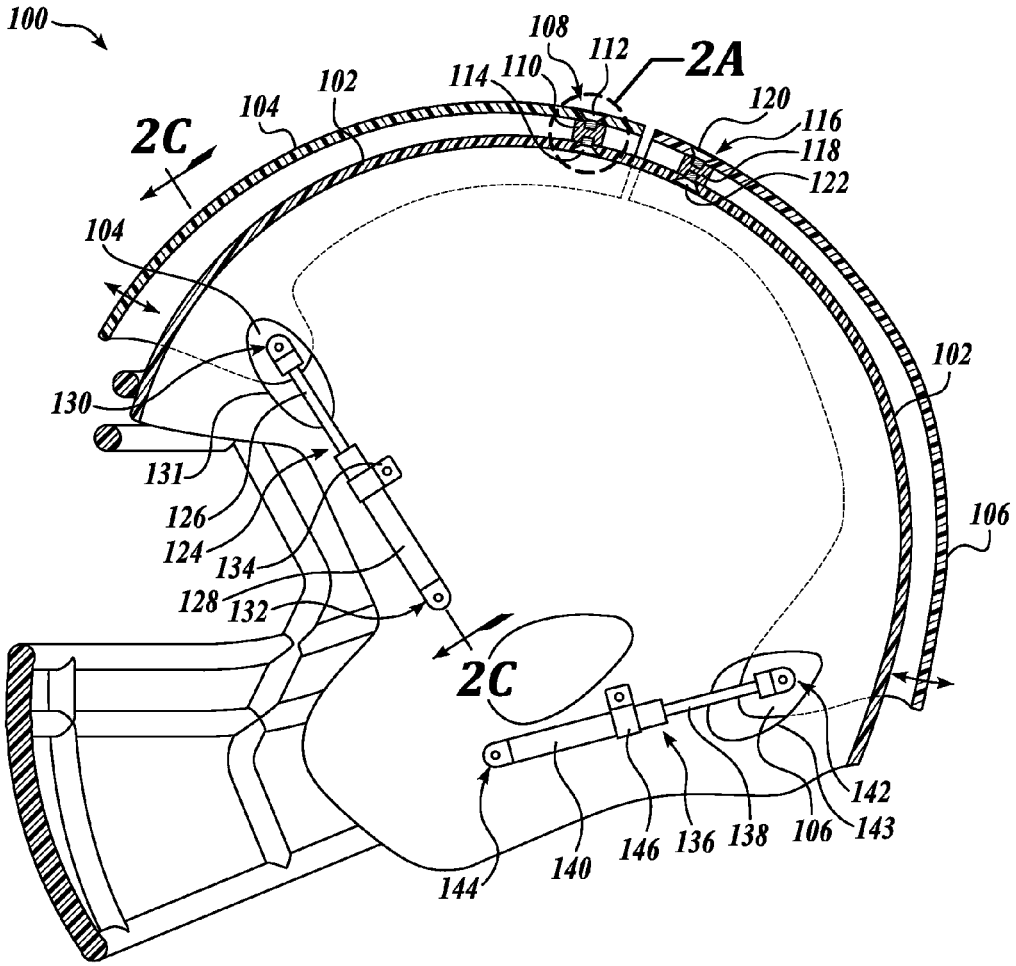
FIG. 1 depicts a cross-sectional side view of an embodiment of a protective helmet, in accordance with embodiments disclosed herein.
Figure 2A:
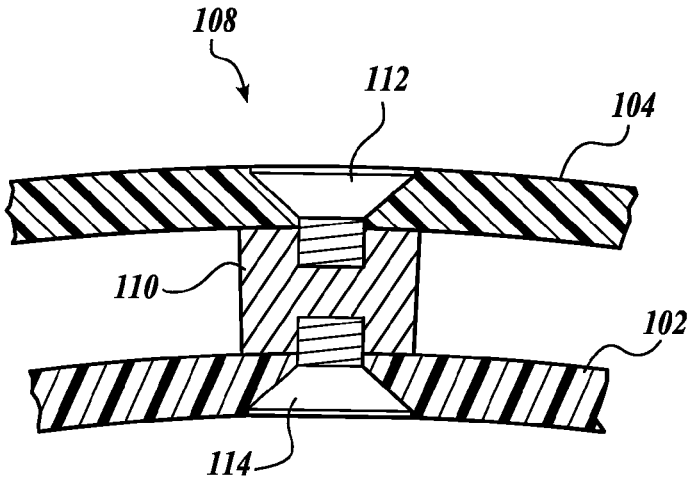
FIGS. 2A and 2B depict partial cross-sectional views of embodiments of rotational mounts that can be used with the protective helmet depicted in FIG. 1, in accordance with embodiments disclosed herein.
Figure 2B:
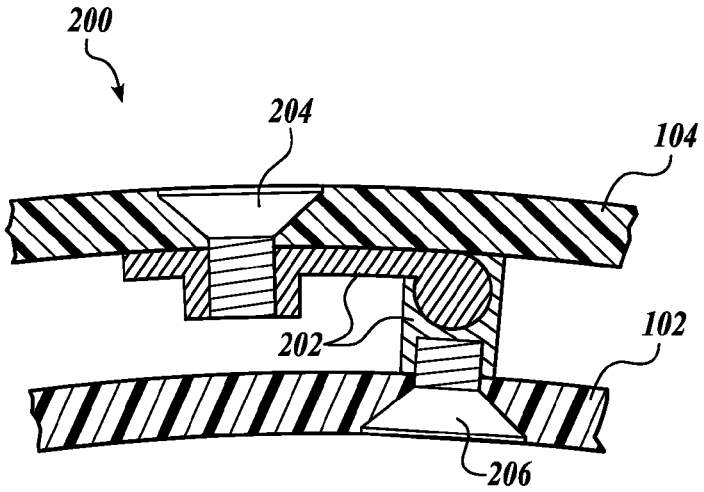
Figure 2C:
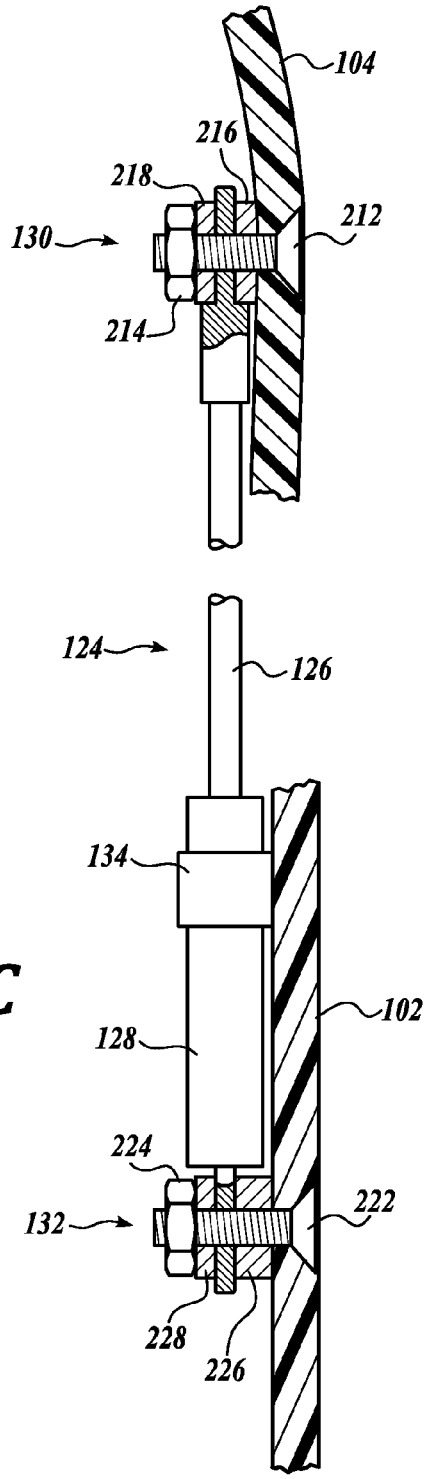
FIG. 2C depicts a sectional view of an embodiment of a shock absorber that can be used with the protective helmet depicted in FIG. 1, in accordance with embodiments disclosed herein.
Figure 2D:
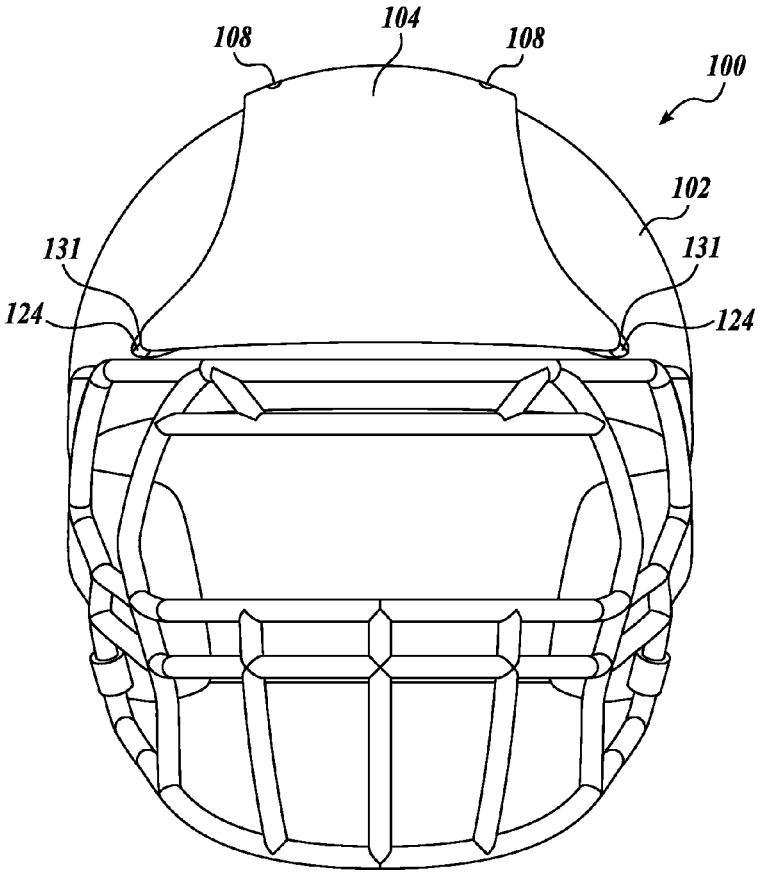
FIGS. 2D and 2E depict front and rear views, respectively, of the protective helmet depicted in FIG. 1, in accordance with embodiments disclosed herein.
Figure 2E:
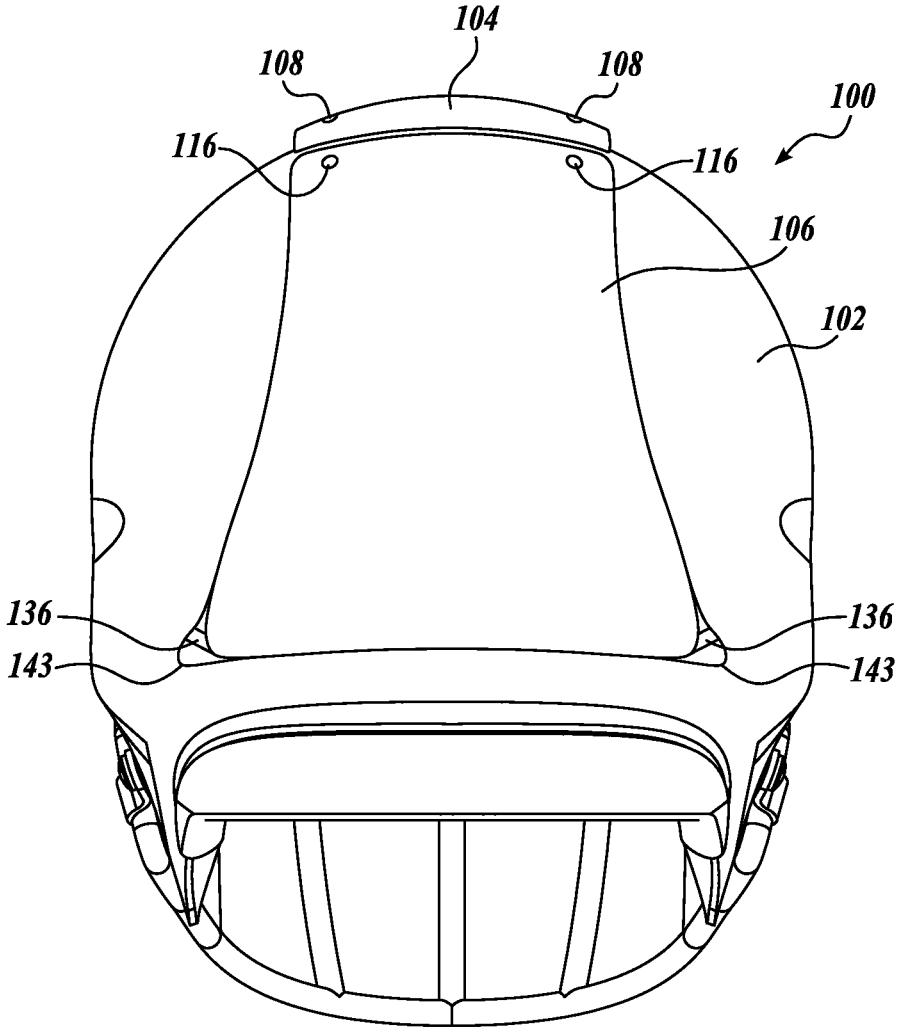

FIGS. 1 and 2A to 2E depict an embodiment of a protective helmet 100. FIG. 1 depicts a cross-sectional side view of the protective helmet 100. FIGS. 2A and 2B depict partial cross-sectional views of embodiments of rotational mounts that can be used with the protective helmet. FIG. 2C depicts a sectional view of an embodiment of a shock absorber that can be used with the protective helmet 100. FIGS. 2D and 2E depict front and rear views, respectively, of the protective helmet. While the protective helmet 100 and other embodiments of protective helmets described herein are shown as football helmets, embodiments of the protective helmet and/or the protective functionality provided herein can be employed by other types of protective headware, including helmets used by the military, police and fire personnel, skiers, skaters, and other adventure sport athletes, motorcycle, bicycle, snow mobile, and scooter riders, just to name a few. In that regard, the techniques and methodologies described below can be employed in any type of gear primarily used to protect the human body, including the head.

The protective helmet 100 depicted in FIG. 1 includes a primary inner shell 102, a first outer impact shell 104, and a second outer impact shell 106. The first and second outer impact shells 104 and 106 are independent of each other. The primary inner shell 102 and the outer impact shells 104 and 106 can be constructed of rigid material such as polycarbonate, acrylonitrile butadiene styrene (ABS), plastic, or other composite, although other suitably rigid materials can be employed. The first outer impact shell 104 is located over a crown portion of the primary inner shell 102 and the second outer impact shell 106 is located over a rear portion of the primary inner shell 102. The crown and rear portions of the primary inner shell 102 are typical areas of impact that result in head, neck, and brain injuries. In one embodiment, the first and second outer impact shells 104 and 106 have contours that are substantially similar to the respective crown and rear portions of the primary inner shell 102. Having a similar contour to the primary inner shell 102 may provide the first and second outer impact shells 104 and 106 with a low profile that is unobtrusive to a wearer of the protective helmet.

The first and second outer impact shells 104 and 106 are hingedly secured to the top of the primary inner shell 102 using rotational mounts 108 and 116, respectively. The embodiments of rotational mounts 108 and 116 depicted in FIG. 1 are flexible mounts and a sectional view of the rotational mount 108 is also depicted in FIG. 2A. The flexible mount 108 includes a flexible component 110, such as rubber, an elastomer, a flexible plastic, or any other resilient material. The flexible component 110 is coupled to the first outer impact shell 104 via a fastener 112 and to the primary inner shell 102 via a fastener 114. The flexible mount 116 includes a flexible component 118, coupled to the second outer impact shell 106 via a fastener 120 and to the primary inner shell 102 via a fastener 122. In some embodiments, the fasteners 112, 114, 120, and 122 include one or more of screws, bolts, nuts, washers, lock washers, rivets, and the like.

In the embodiments depicted in FIGS. 1 and 2A, the rotational mounts 108 and 116 are flexible mounts. In other embodiments, one or both of the rotational mounts 108 and 116 is a hinge mount, such as the rigid hinge mount 200 depicted in FIG. 2B. The rigid hinge mount 200 includes a rigid hinge 202. In some embodiments, the rigid hinge 202 is made from a rigid material, such as polycarbonate, ABS, hard plastic, another composite, metal, etc. The rigid hinge 202 is coupled to the first outer impact shell 104 via a fastener 204 and to the primary inner shell 102 via a fastener 206. In other embodiments, the rotational mounts 108 and 116 include other type of rotational mount.

In the embodiment shown in FIG. 1, a first end of each of the first and second outer impact shells 104 and 106 is hingedly secured to the primary inner shell 102 via rotational mounts 108 and 116, respectively. In some embodiments, the each of the first and second outer impact shells 104 and 106 is hingedly secured to the primary inner shell 102 via multiple rotational mounts. In the embodiments shown in FIGS. 2D and 2E, the first outer impact shell 104 is coupled to the primary inner shell 102 via multiple rotational mounts 108 and the second outer impact shell 106 is coupled to the primary inner shell 102 via multiple rotational mounts 116.

Second ends of the first and second outer impact shells 104 and 106 are coupled to the primary shell 102 by at least one shock absorber 124 and at least one shock absorber 136, respectively. In the particular embodiment shown in FIG. 1, the second end of the first outer impact shell 104 is coupled to the primary shell 102 via a shock absorber 124. In the embodiment shown in FIG. 1 and the sectional view shown in FIG. 2C, the shock absorber 124 is in the form of a closed gas or hydraulic shock absorber. The shock absorber 124 includes a piston 126 and a cylinder 128. An end of the piston 126 is coupled to an inner side of the second end of the first outer impact shell 104 via a fastener coupling 130. In the embodiment shown in FIG. 1, the piston 126 passes through an opening 131 in the primary inner shell 102. An end of the cylinder 128 is coupled to an inner side of the primary inner shell 102 via a fastener coupling 132. In the embodiment shown in FIG. 1, cylinder 128 is further coupled to the inner side of the primary inner shell 102 via a clamp 134. In some embodiments, the fastener couplings 130 and 132 permit each end of the shock absorber 124 to rotate while the clamp 134 of the shock absorber 124 maintains a straight-line transmission of force from the first outer impact shell 104 through the shock absorber 124 to the primary inner shell 102.

As shown in the sectional view in FIG. 2C, the shock absorber 124 is fastened to the primary inner shell 102 and the first outer impact shell 104 using fastener couplings 130 and 132. In one embodiment, the fastener coupling 130 includes a screw 212 which passes through the first outer impact shell 104 and the end of the piston 126. The screw 212 is secured with a nut 214. The coupling assembly 130 also includes washers 216 and 218. In some embodiments, the washer 216 is a contoured washer that has a contour to accommodate a contour of the first outer impact shell 104 and/or an angle of the piston 126 with respect to the first outer impact shell 104. In one embodiment, the fastener coupling 132 includes a screw 222 which passes through the primary inner shell 102 and the end of the cylinder 128. The screw 222 is secured with a nut 224. The coupling assembly 132 also includes washers 226 and 228. In some embodiments, the washer 226 is a contoured washer that has a contour to accommodate a contour of the primary inner shell 102 and/or an angle of the cylinder 128 with respect to the primary inner shell 102. In other embodiments, one or both of the fastener couplings 130 and 132 includes different fasteners (e.g., rivets, bolts, etc.) configured to couple the shock absorber 124 to the primary inner shell 102 and/or the first outer impact shell 104.

In the particular embodiment shown in FIG. 1, the second end of the second outer impact shell 106 is coupled to the primary shell 102 via a shock absorber 136. In the embodiment shown in FIG. 1, the shock absorber 136 is in the form of a closed gas or hydraulic shock absorber. The shock absorber 136 includes a piston 138 and a cylinder 140. An end of the piston 138 is coupled to an inner side of the second end of the second outer impact shell 106 via a fastener coupling 142. In the embodiment shown in FIG. 1, the piston 138 passes through an opening 143 in the primary inner shell 102. An end of the cylinder 140 is coupled to an inner side of the primary inner shell 102 via a fastener coupling 144. In the embodiment shown in FIG. 1, cylinder 140 is further coupled to the inner side of the primary inner shell 102 via a clamp 146. In some embodiments, the fastener couplings 142 and 144 permit each end of the shock absorber 136 to rotate while the clamp 146 of the shock absorber 136 maintains a straight-line transmission of force from the second outer impact shell 106 through the shock absorber 136 to the primary inner shell 102.

In some embodiments, the shock absorbers 124 and 136 are rated to a specific force value. The shock absorber 124 resists rotational motion of the first outer impact shell 104 toward the crown portion of the primary inner shell 102 and shock absorber 136 resists rotational motion of the second outer impact shell 106 toward the rear portion of the primary inner shell 102. The use of closed gas/hydraulic shock absorbers also resists rotational movement of the first and second outer impact shells 104 and 106 away from the primary inner shell 102 to provide a controlled rebound. A controlled rebound eliminates any whiplash effect produced by a typical spring loaded shock absorber. Furthermore, the force value of the shock absorbers 124 and 136 can be selected based on factors, such as the wearer's weight, typical activity speed, type of activity, and the like, to cater to the wearer's desired level of impact absorption.

The inner shell 102 can be lined with the cushioning (e.g., padding) for impact and fitment. Such cushioning is known in the art. The impact reduction provided by the protective helmet depicted in FIG. 1 may allow for reduction of the typical amount of internal cushioning and rigid shell material used to construct the primary inner shell 102. Such reduction in materials reduces the weight and size of typical helmets, resulting in less strain on the head and neck and greater comfort for the wearer. In some embodiments, with the protective helmet 100 depicted in FIG. 1, the internal cushioning is also configured to prevent the shock absorbers 124 and 136 from contacting the head of a user of the protective helmet 100.

When the first outer impact shell 104 is impacted, the first outer impact shell 104 rotates toward the primary inner shell 102, decreasing the gap between first outer impact shell 104 and the primary inner shell 102. The force of the impact on the first outer impact shell 104 is transmitted through the shock absorber 124 to the primary inner shell 102. This transmission of force significantly reduces the overall impact force transmitted to the neck and head by absorbing the impact energy and slowing down the rate of change in head and neck movement prior to the first outer impact shell 104 reaching the primary inner shell 102. The remaining impact force transmitted to inner shell 102 is then absorbed by the internal cushioning as typical helmets do. The second outer impact shell 106 performs substantially similar to the performance of the first outer impact shell 104 described here, resulting in absorption of some of the impact force on the rear of the helmet before the second outer impact shell 106 rotates and impacts the primary inner shell 102. Traditional helmets may not be able to absorb the impact force to prevent head, neck, and brain injuries. The embodiment of a protective helmet 100 depicted in FIG. 1 significantly improves impact protection over traditional helmets.

The embodiment of a protective helmet depicted in FIG. 1 can also include a facemask, a chin strap, and other components that are common and well known in the art. Further weight reduction can be obtained by replacing the traditional steel-coated facemasks with facemasks constructed of lighter materials, such as aluminum, composite materials, such as carbon fiber, or a variety of plastics.

Figure 3A:
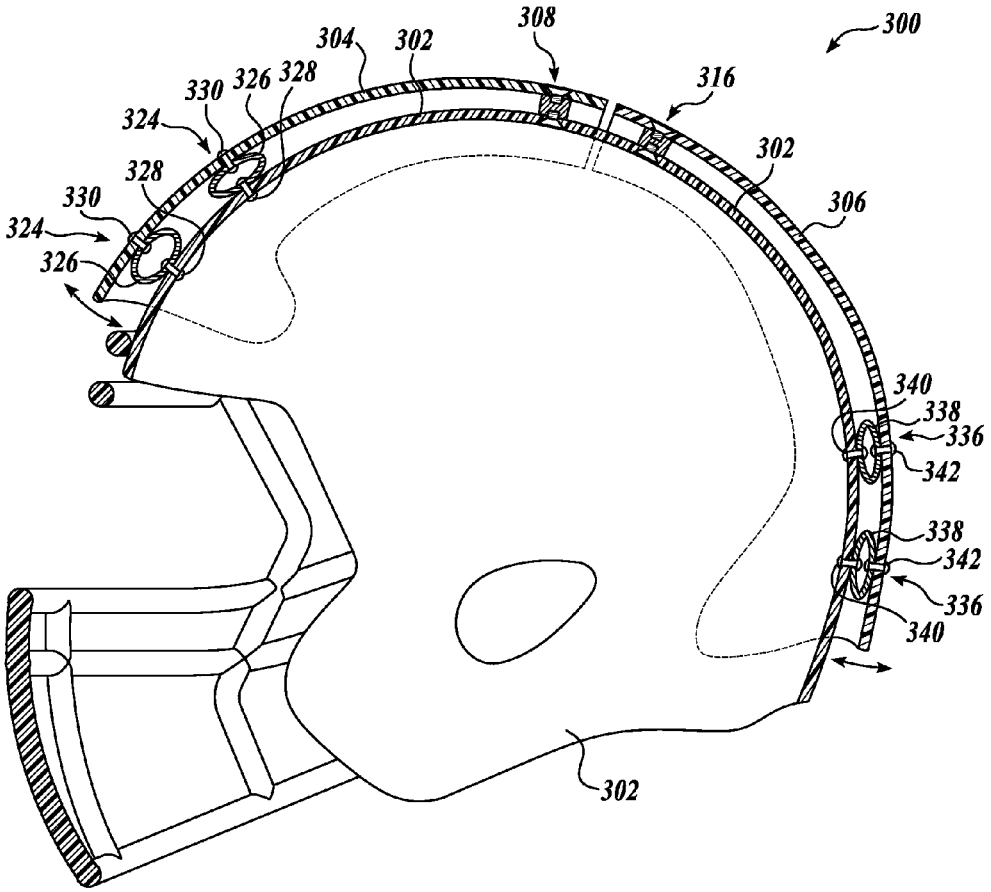
FIGS. 3A to 3C depict cross-sectional side views of other embodiments of protective helmets, in accordance with embodiments disclosed herein.
Figure 3B:
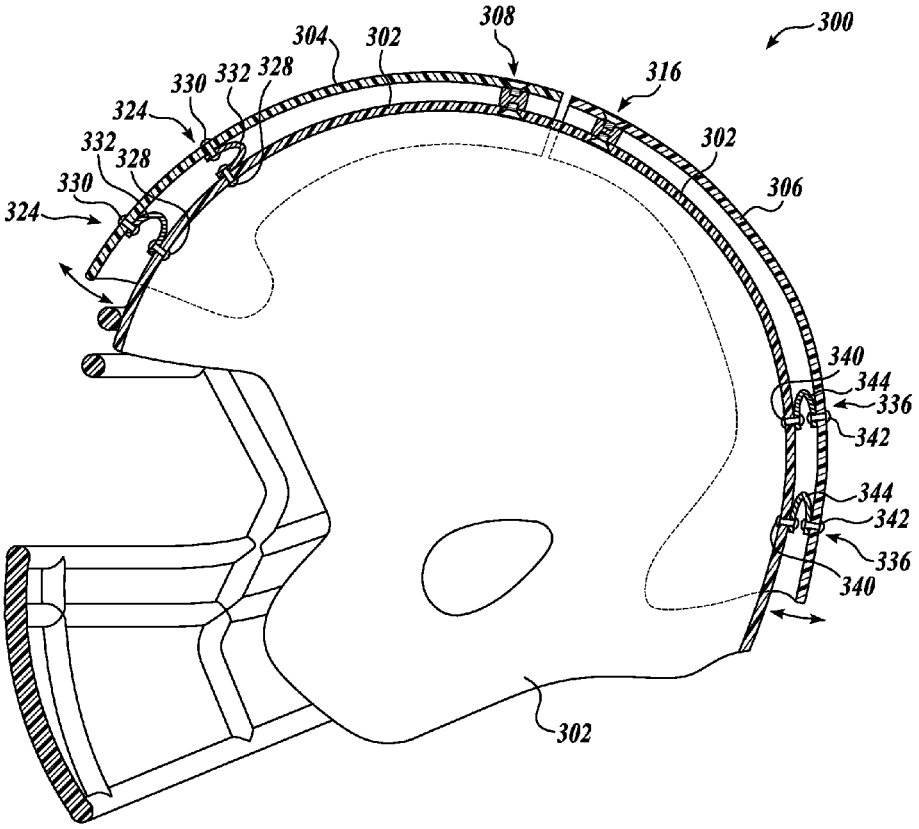
Figure 3C:
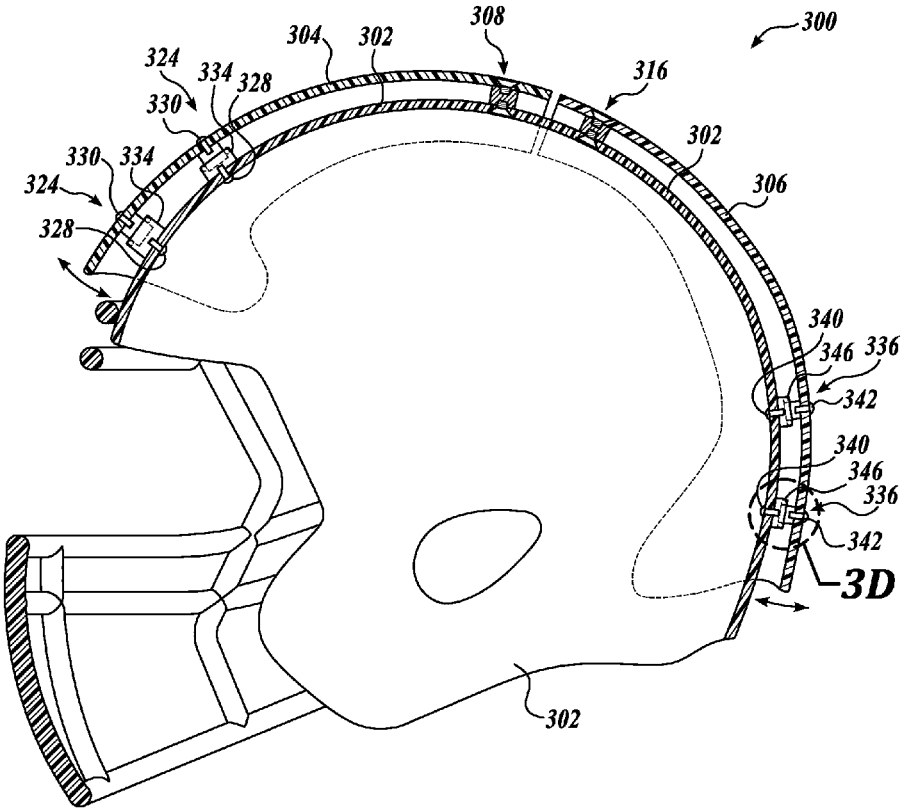

FIGS. 3A to 3C depict cross-sectional side views of various embodiments of a protective helmet 300. The protective helmet 300 includes a primary inner shell 302, a first outer impact shell 304, and a second outer impact shell 306. The first and second outer impact shells 304 and 306 are independent of each other. The primary inner shell 302 and the outer impact shells 304 and 306 can be constructed of rigid material such as polycarbonate, acrylonitrile butadiene styrene (ABS), plastic, or other composite. The first outer impact shell 304 is located over a crown portion of the primary inner shell 302 and the second outer impact shell 306 is located over a rear portion of the primary inner shell 302. The crown and rear portions of the primary inner shell 302 are typical areas of impact that result in head, neck, and brain injuries. In one embodiment, the first and second outer impact shells 304 and 306 have contours that are substantially similar to the respective crown and rear portions of the primary inner shell 302.

A first end of each of the first and second outer impact shells 304 and 306 is hingedly secured to the top of the primary inner shell 302 using rotational mounts 308 and 316, respectively. Each of the embodiments of the protective helmet 300 depicted in FIGS. 3A to 3C includes shock absorbers 324 and 336 coupling a second end of each of the first and second outer impact shells 304 and 306 to the primary inner shell 302. The shock absorbers 324 resist rotational motion of the first outer impact shell 304 toward the crown portion of the primary inner shell 302 and the shock absorbers 336 resist rotational motion of the second outer impact shell 306 toward the rear portion of the primary inner shell 302. A force value of the shock absorbers 324 and 336 can be selected based on factors, such as the wearer's weight, typical activity speed, type of activity, and the like, to cater to the wearer's desired level of impact absorption.

In FIG. 3A, the shock absorbers 324 and 336 include compression springs 326 and 338 instead of the closed gas/hydraulic shock absorbers depicted in FIG. 1. The compression springs are constructed of a flexible, impact absorbing material, such as plastic, composite, rubber, or any other suitable material, and are designed to withstand a specific force. The round shape of the compression springs 326 and 338 is compressible, allowing them to absorb impact energy beyond the material's hardness and compressibility alone. The compression springs 326 are fastened to the primary inner shell 302 using fasteners 328 and to the first outer impact shell 304 using fasteners 330. The compression springs 338 are fastened to the primary inner shell 302 using fasteners 340 and to the second outer impact shell 306 using fasteners 342. The fasteners 328, 330, 340, and 342 can be screws, bolts, rivets, or any other form of mechanical fasteners.

When one of the first and second outer impact shells 304 and 306 is impacted, the impacted one of the first and second outer impact shells 304 and 306 rotates inward, decreasing the gap with the primary inner shell 302 while transmitting the impact force through the compression springs 326 or 338 and, ultimately, to the primary inner shell 302. This transmission of force significantly reduces the overall force of the impact by absorbing some of the impact energy and slowing down the rate of change in head and neck movement before the impacted one of the first and second outer impact shells 304 and 306 contacts the primary inner shell 302. The remaining impact force is transmitted to the primary inner shell 302 and then absorbed by any internal cushioning.

FIG. 3B depicts another embodiment of the protective helmet 300. FIG. 3B depicts the protective helmet 300 with the primary inner shell 302 and the first and second outer impact shells 304 and 306. The embodiment shown in FIG. 3B also shows an embodiment of shock absorbers 324 and 336 in the form of leaf-springs 332 and 344 (also called "U springs") instead of the closed gas/hydraulic shock absorbers 124 and 136 depicted in FIG. 1. The leaf-springs 332 and 344 are constructed of a flexible impact absorbing material, such as plastic, composite, rubber, or any other suitable material, and are designed to withstand a specific force. The semi-round shape of the leaf-springs 332 and 344 is compressible, allowing it to absorb impact energy beyond the material's hardness and compressibility. The leaf-springs 332 are fastened to the primary inner shell 302 using fasteners 328 and to the first outer impact shell 304 using fasteners 330. The leaf-springs 344 are fastened to the primary inner shell 302 using fasteners 340 and to the second outer impact shell 306 using fasteners 342. The fasteners 328, 330, 340, and 342 can be screws, bolts, rivets, or any other form of mechanical fasteners.

When one of the first and second outer impact shells 304 and 306 is impacted, the impacted one of the first and second outer impact shells 304 and 306 rotates inward, decreasing the gap with the primary inner shell 302 while transmitting the impact force through the leaf springs 332 or 344 and, ultimately, to the primary inner shell 302. This transmission of force significantly reduces the overall force of the impact by absorbing some of the impact energy and slowing down the rate of change in head and neck movement before the impacted one of the first and second outer impact shells 304 and 306 contacts the primary inner shell 302. The remaining impact force is transmitted to the primary inner shell 302 and then absorbed by any internal cushioning.

Figure 3D:
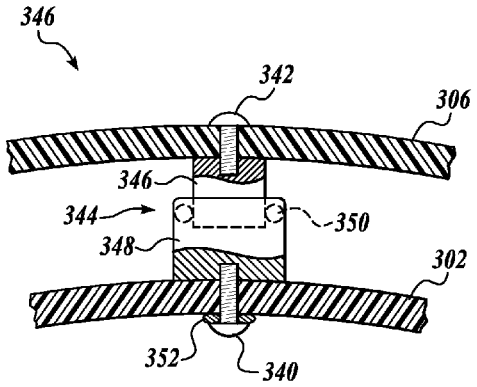
FIG. 3D depicts a partial cross-sectional view of an embodiment of another shock absorber that can be used with the protective helmet depicted in FIG. 3C.

FIG. 3C depicts another embodiment of the protective helmet 300. FIG. 3C depicts the protective helmet 300 with the primary inner shell 302 and the first and second outer impact shells 304 and 306. The embodiment shown in FIG. 3C also shows shock absorbers 324 and 336 in the form of low-profile pistons and cylinders 334 and 346 instead of the closed gas/hydraulic shock absorbers 124 and 136 depicted in FIG. 1. The low-profile piston and cylinders 334 and 346 can be pneumatic and/or gas piston and cylinder. As shown in the detail view of FIG. 3D, the low-profile piston and cylinders 334 and 346 can include a piston 346, a cylinder 348, and seal 350 that seals the piston 346 to the cylinder 348 such that movement of the piston 346 into the cylinder 348 is resisted by the pressure in the cylinder 348. The low-profile piston and cylinders 334 and 346 can be constructed of lightweight material, such as aluminum, plastic, or a composite. The low profile piston and cylinders are pre-charged to a specific force value, and any impact force on the first and second outer impact shells 304 and 306 compresses the piston against the pre-charged force. The low-profile piston and cylinders 334 are fastened to the primary inner shell 302 using fasteners 328 and to the first outer impact shell 304 using fasteners 330. The low-profile piston and cylinders 346 are fastened to the primary inner shell 302 using fasteners 340 and to the second outer impact shell 306 using fasteners 342. The fasteners 328, 330, 340, and 342 can be screws, bolts, rivets, or any other form of mechanical fasteners.

Figure 3E:
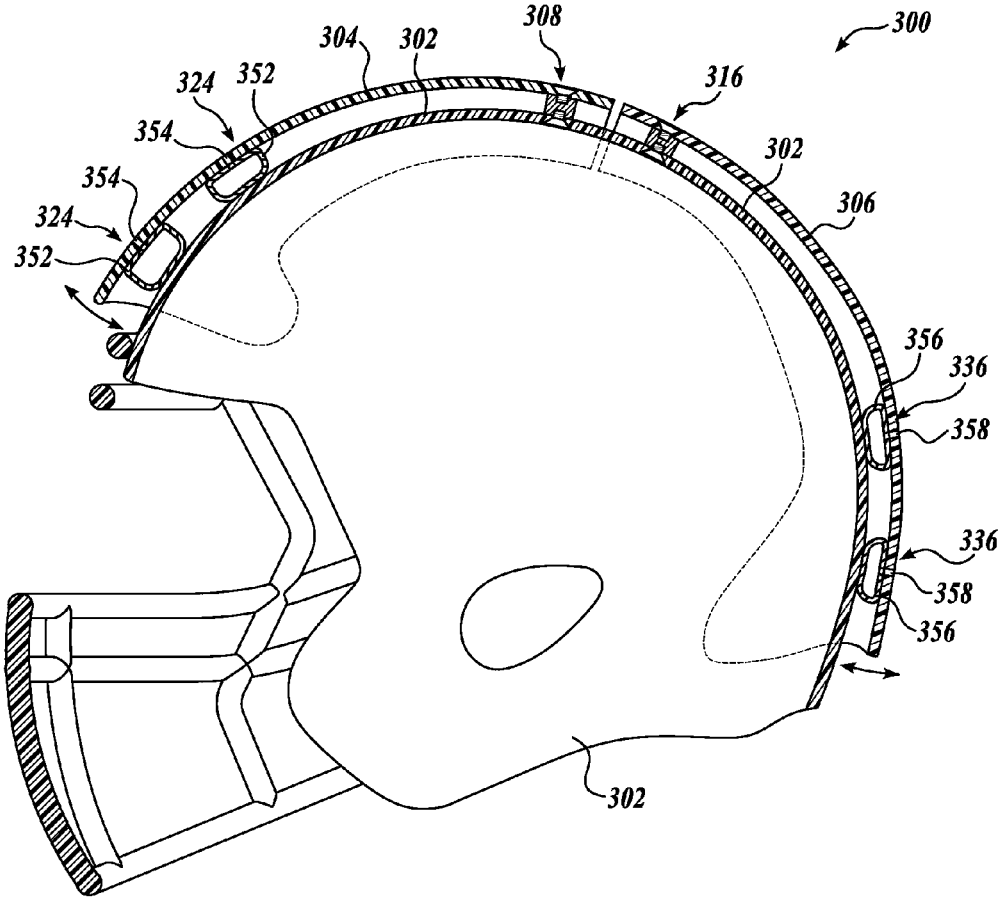
FIGS. 3E and 3F depict cross-sectional side views of other embodiments of protective helmets, in accordance with embodiments disclosed herein.

FIG. 3E depicts another embodiment of the protective helmet 300. FIG. 3E depicts the protective helmet 300 with the primary inner shell 302 and the first and second outer impact shells 304 and 306. The embodiment shown in FIG. 3E also shows shock absorbers 324 and 336 in the form of pneumatic bladders 352 and 356 instead of the closed gas/hydraulic shock absorbers 124 and 136 depicted in FIG. 1. In the depicted embodiment, the pneumatic bladders 352 and 356 are coupled to the first and second outer impact shells 304 and 306. Orifices 354 and 358 are located in the first and second outer impact shells 304 and 306 to permit fluid to be selectively inserted into or removed from the pneumatic bladders 352 and 356. In some examples, the fluid is a gas, such as air, or a fluid, such as water. The ability to selectively insert fluid into or remove fluid from the pneumatic bladders 352 and 356 allows for the resistance of the pneumatic bladders 352 and 356 to be adjusted by a user. While the embodiment shown in FIG. 3E shows the pneumatic bladders 352 and 356 and the orifices 354 and 358 coupled to the first and second outer impact shells 304 and 306, in other embodiments, the pneumatic bladders 352 and 356 and the orifices 354 and 358 are coupled to the primary inner shell 302 under the first and second outer impact shells 304 and 306, respectively.

In some embodiments, the pneumatic bladders 352 and 356 are pneumatic cells or pneumatic pads that are filled with air and are configured to allow air to escape out of the orifices 354 and 358 upon impact of the first or second outer impact shells 304 and 306. In some examples, the orifices 354 and 358 are configured to control a flow rate of air out of the orifices 354 and 358. In this way, an impact on the first or second outer impact shells 304 and 306 collapses the pneumatic bladders 352 and 356 at a controlled rate to dissipate some of the energy of the impact. In some examples, after an impact, pneumatic cells or pneumatic pads memory causes air to be drawn back into the pneumatic bladders 352 and 356 via the orifices 354 and 358 until the pneumatic bladders 352 and 356 return to their form from before the impact.

Figure 3F:
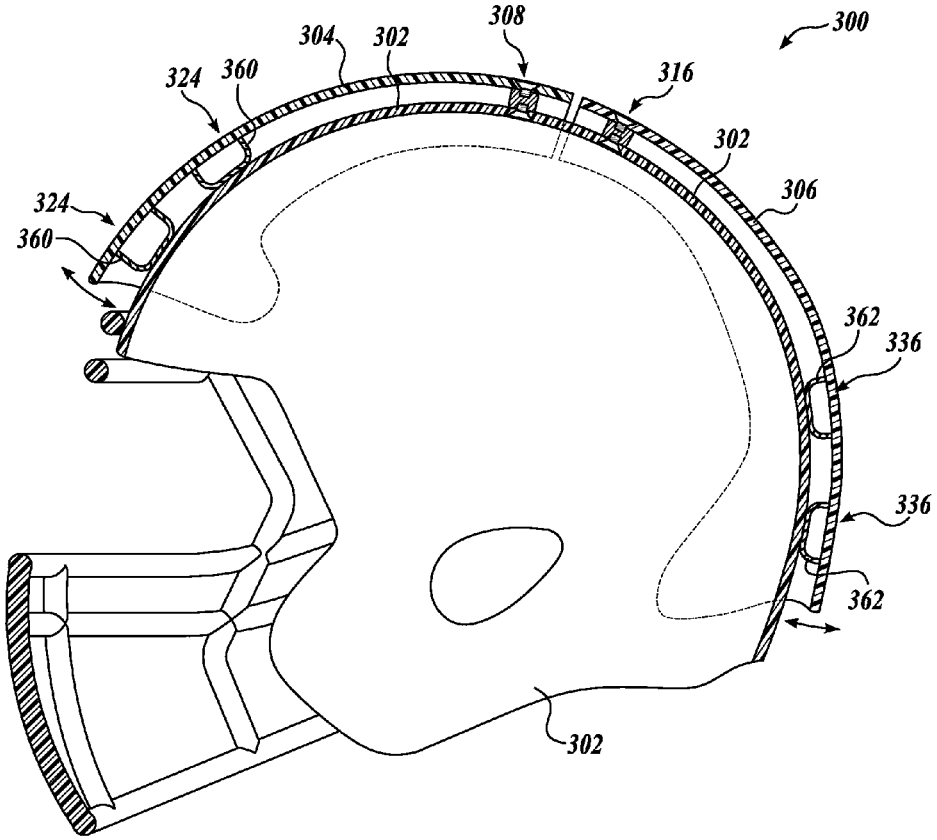

FIG. 3F depicts another embodiment of the protective helmet 300. FIG. 3F depicts the protective helmet 300 with the primary inner shell 302 and the first and second outer impact shells 304 and 306. The embodiment shown in FIG. 3F also shows shock absorbers 324 and 336 in the form of cushioning pads 360 and 362 instead of the closed gas/hydraulic shock absorbers 124 and 136 depicted in FIG. 1. In the depicted embodiment, the cushioning pads 360 and 362 are coupled to the first and second outer impact shells 304 and 306. In some examples, the cushioning pads 360 and 362 are made from a compliant material, such as elastomers, foams, polyurethane gel, and the like. In some embodiments, the cushioning pads 360 and 362 are coupled to the first and second outer impact shells 304 and 306 via an adhesive, a fastener, or any other means. While the embodiment shown in FIG. 3F shows the cushioning pads 360 and 362 coupled to the first and second outer impact shells 304 and 306, in other embodiments, the cushioning pads 360 and 362 are coupled to the primary inner shell 302 under the first and second outer impact shells 304 and 306, respectively.

When one of the first and second outer impact shells 304 and 306 is impacted, the impacted one of the first and second outer impact shells 304 and 306 rotates inward, decreasing the gap with the primary inner shell 302 while transmitting the impact force through the shock absorbers 324 and 336 and, ultimately, to the primary inner shell 302. This transmission of force significantly reduces the overall force of the impact by absorbing some of the impact energy and slowing down the rate of change in head and neck movement before the impacted one of the first and second outer impact shells 304 and 306 contacts the primary inner shell 302. The remaining impact force is transmitted to the primary inner shell 302 and then absorbed by any internal cushioning.

Figure 4A:
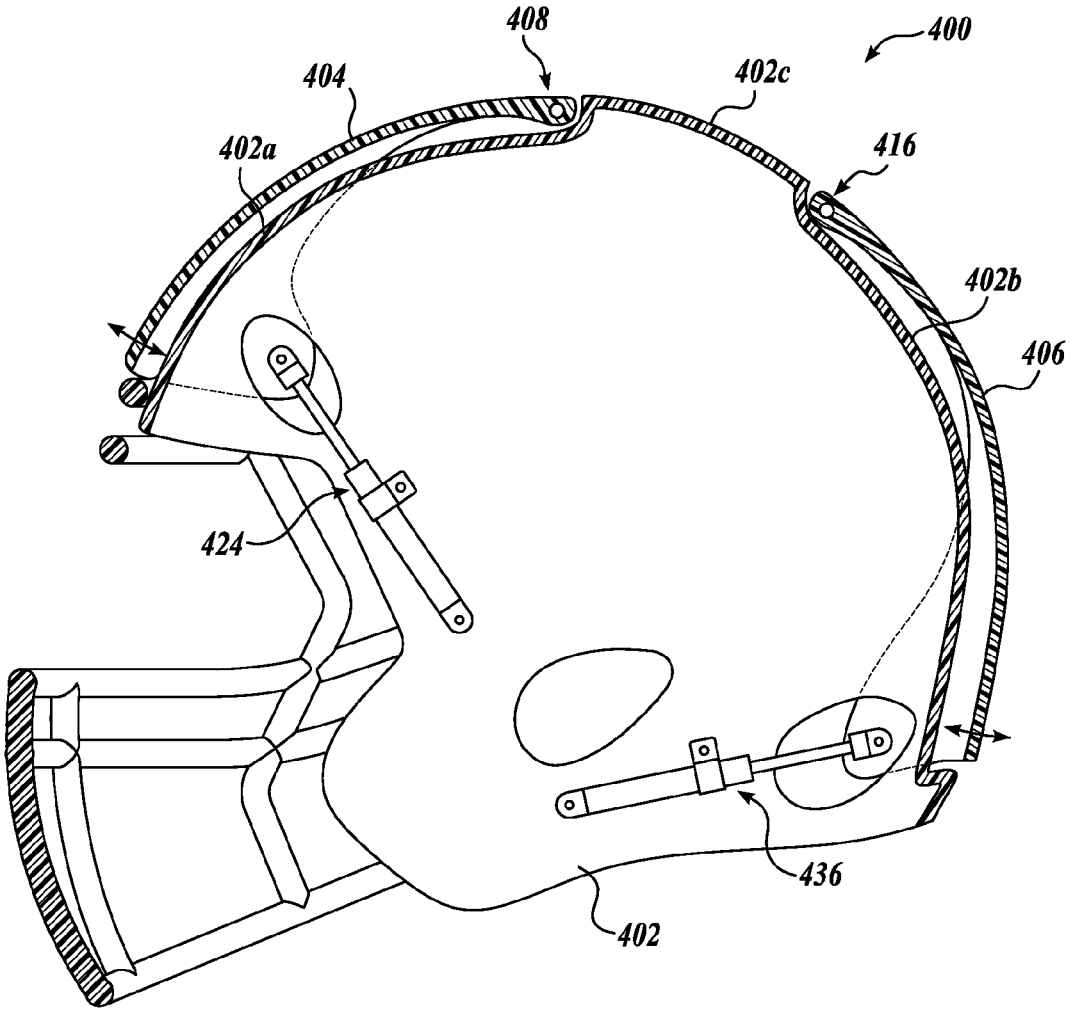
FIG. 4A depicts a cross-sectional side view of another embodiment of a protective helmet, in accordance with embodiments disclosed herein.

FIG. 4A depicts a cross-sectional side view of another embodiment of a protective helmet 400. The protective helmet 400 depicted in FIG. 4A includes a primary inner shell 402, a first outer impact shell 404, and a second outer impact shell 406. In some embodiments, the primary inner shell 402 and the outer impact shells 404 and 406 are constructed of rigid material such as polycarbonate, ABS, plastic, or other composite.

The first outer impact shell 404 is located in a depressed crown portion 402*a* of the primary inner shell 402 and the second outer impact shell 406 is located over a depressed rear portion 402*b* of the primary inner shell 402. In the depicted embodiment, a central portion 402*c* of the primary inner shell 402 is located between the depressed crown portion 402*a* and the depressed rear portion 402*b*. The central portion 402*c* is not depressed (i.e., the central portion 402*c* has a contour that corresponds with portions of the primary inner shell 402 other than the depressed crown portion 402*a* and the depressed rear portion 402*b*). In one embodiment, the first and second outer impact shells 404 and 406 have contours that correspond with portions of the primary inner shell 402 other than the depressed crown portion 402*a* and the depressed rear portion 402*b*. In this way, the protective helmet 400 appears to have a smooth contour between the first and second outer impact shells 404 and 406 and the portions of the primary inner shell 402 other than the depressed crown portion 402*a* and the depressed rear portion 402*b*. Having a smooth contour to the first and second outer impact shells 404 and 406 and the portions of the primary inner shell 402 other than the depressed crown portion 402*a* and the depressed rear portion 402*b* may be unobtrusive to a wearer of the protective helmet and may provide a desirable aesthetic look to the protective helmet 400.

Figure 4B:
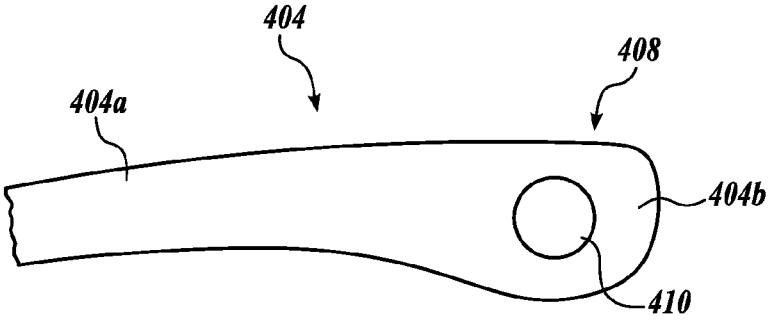
FIGS. 4B and 4C depict, respectively, a side sectional view of the first outer impact shell depicted in FIG. 4A and a front cross-sectional view of a rotational mount depicted in FIG. 4A, in accordance with embodiments disclosed herein.
Figure 4C:
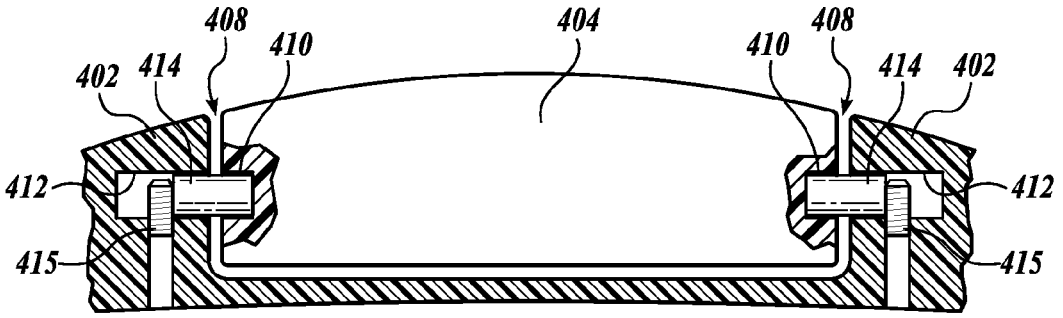

The first and second outer impact shells 404 and 406 are hingedly secured to the primary inner shell 402 using rotational mounts 408 and 416, respectively. The embodiments of rotational mounts 408 and 416 depicted in FIG. 4A are axle mounts; however, any other type of rotational mount could be used for rotational mounts 408 and 416. A side sectional view of the first outer impact shell 404 is depicted in FIG. 4B and a front cross-sectional view of the rotational mount 408 is depicted in FIG. 4C. FIGS. 4B and 4C show embodiments of the primary inner shell 402 and the rotational mounts 408. However, the embodiments and functions described with respect to the primary inner shell 402 and the rotational mounts 408 can be applied to the second outer impact shell 406 and the rotational mounts 416. Second ends of the first and second outer impact shells 404 and 406 are coupled to the primary shell 402 by at least one shock absorber 424 and at least one shock absorber 436, respectively.

As shown in FIG. 4B, the first outer impact shell 404 has a first portion 404*a* and a second portion 404*b*. The first portion 404*a* is generally thinner than the second portion 404*b*. In some embodiments, the first portion 404*a* has a uniform thickness or a varying thickness. The thickness of the second portion 404*b* is generally greater than the first portion 404*a* to accommodate bores 410. As shown in FIG. 4C, the bores 410 are configured to align with bores 412 in the primary inner shell 402. Axles 414 are located in the bores 410 and bores 412 to couple the first outer impact shell 404 to the primary inner shell 402 and permit rotation of the first outer impact shell 404 with respect to the primary inner shell 402.

In some embodiments the rotational mount 408 is a releasable rotational mount that permits the first outer impact shell 404 to be removed from the primary inner shell 402. This ability may be useful under certain circumstance, such as when the first outer impact shell 404 needs to be replaced. The first outer impact shell 404 can be removed from the primary inner shell 402 and replaced with a new first outer impact shell. Such a replacement may be significantly less expensive than replacing the entire protective helmet 400. In the embodiment shown in FIG. 4C, set screws 415 are positioned within the primary inner shell 402 to hold the axles 414 in place. The set screws 415 may be retracted to allow the axles 414 to retract out of the bores 410 and fully into the bores 412 such that the first outer impact shell 404 can be removed. Alternatives to the embodiment shown in FIG. 4C are possible, such as using spring-loaded axles, retractable pins, and the like.

Figure 5A:
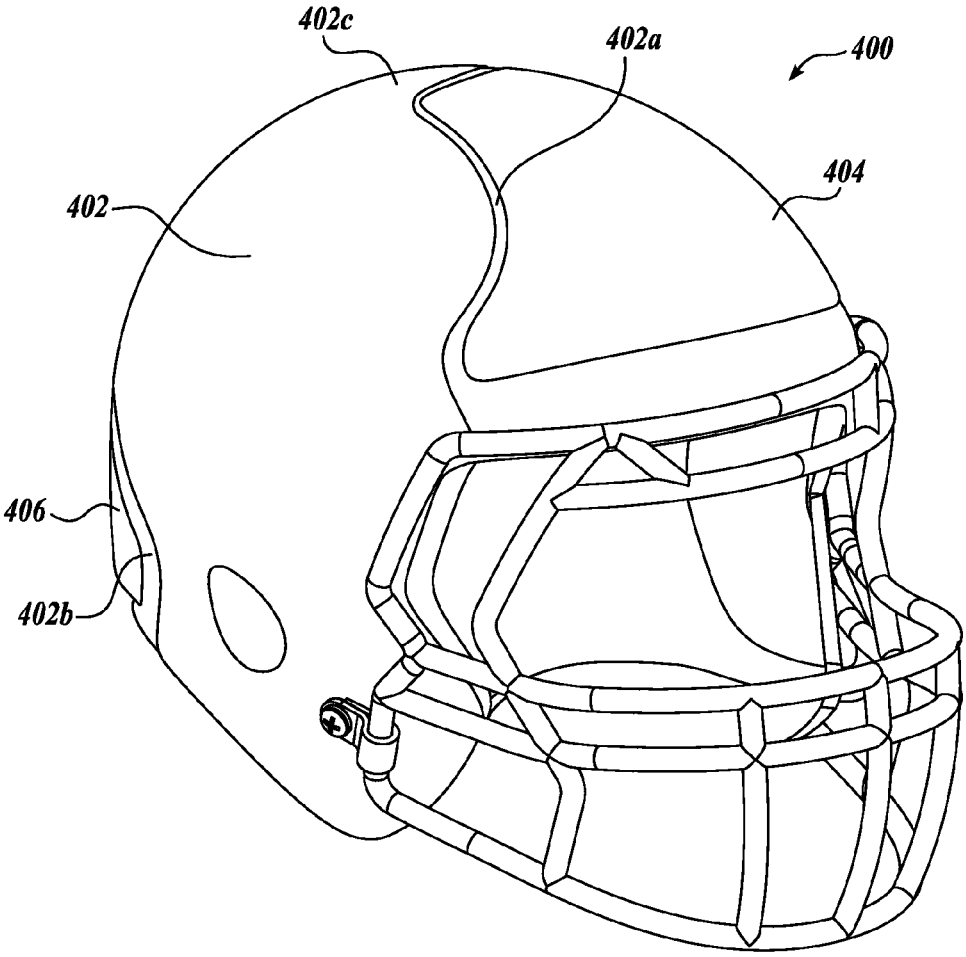
FIGS. 5A to 5F depict, respectively, prospective, front, back, top, bottom, and side views of the design of the protective helmet depicted in FIG. 4A, in accordance with embodiments disclosed herein.
Figure 5B:
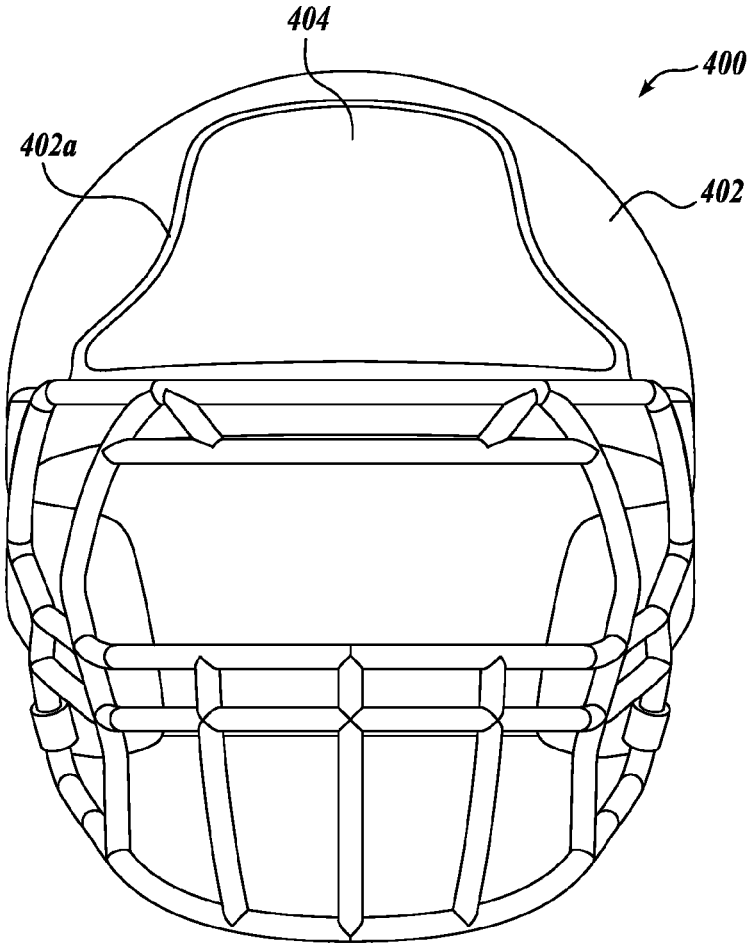
Figure 5C:
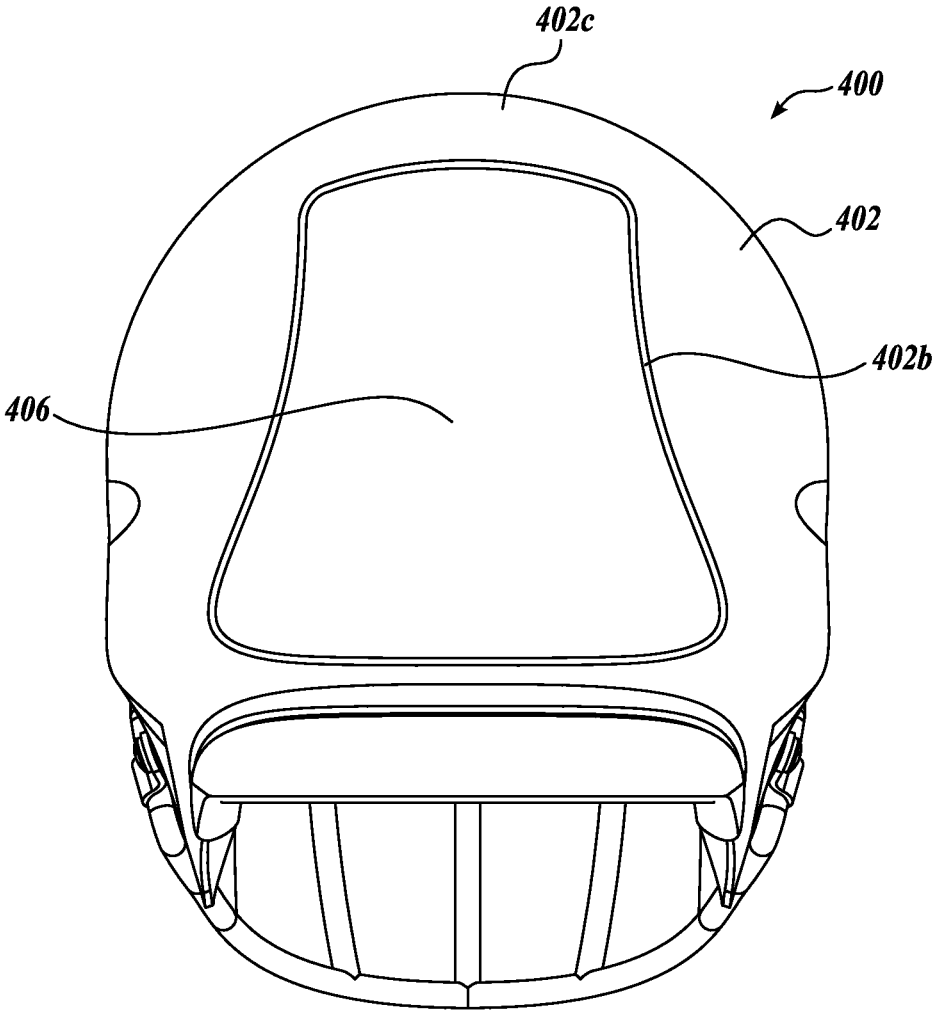
Figure 5D:
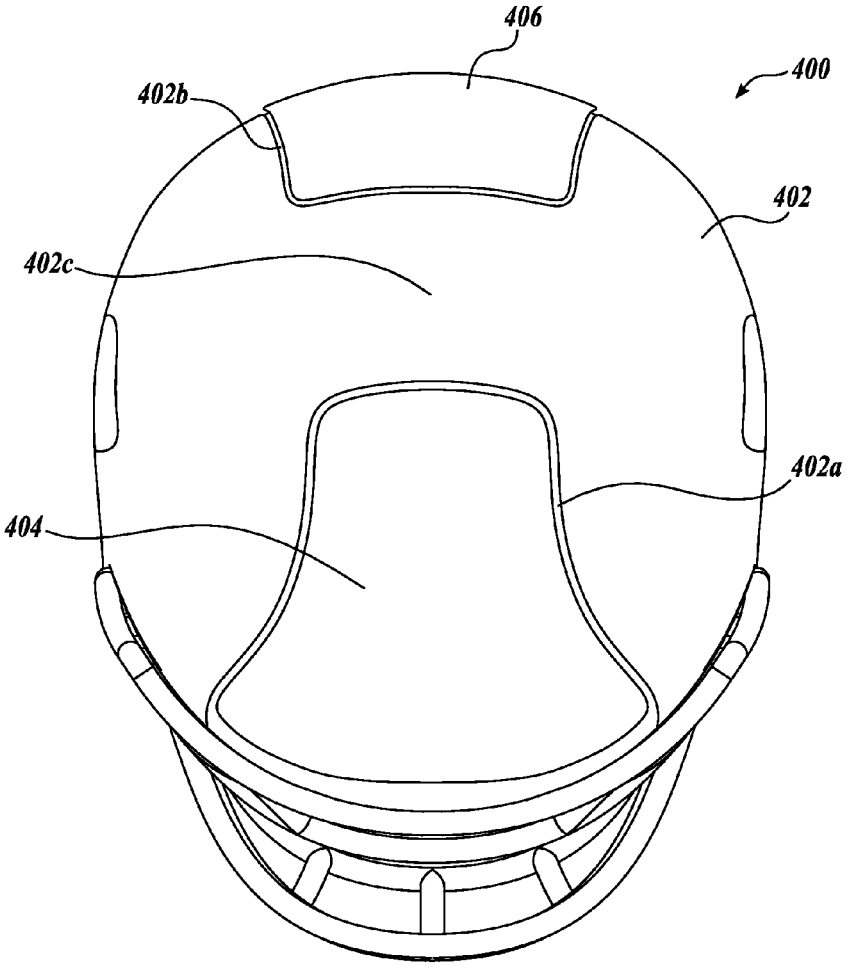
Figure 5E:
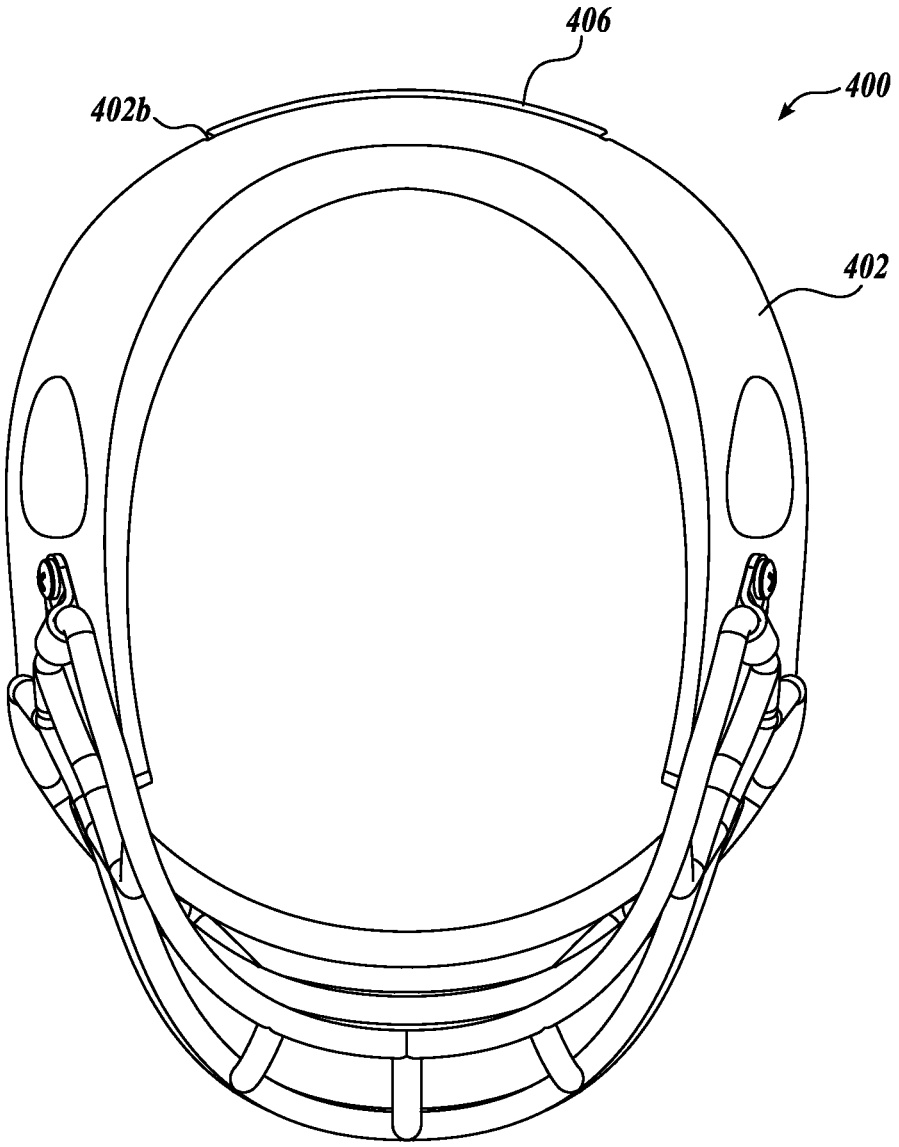
Figure 5F:
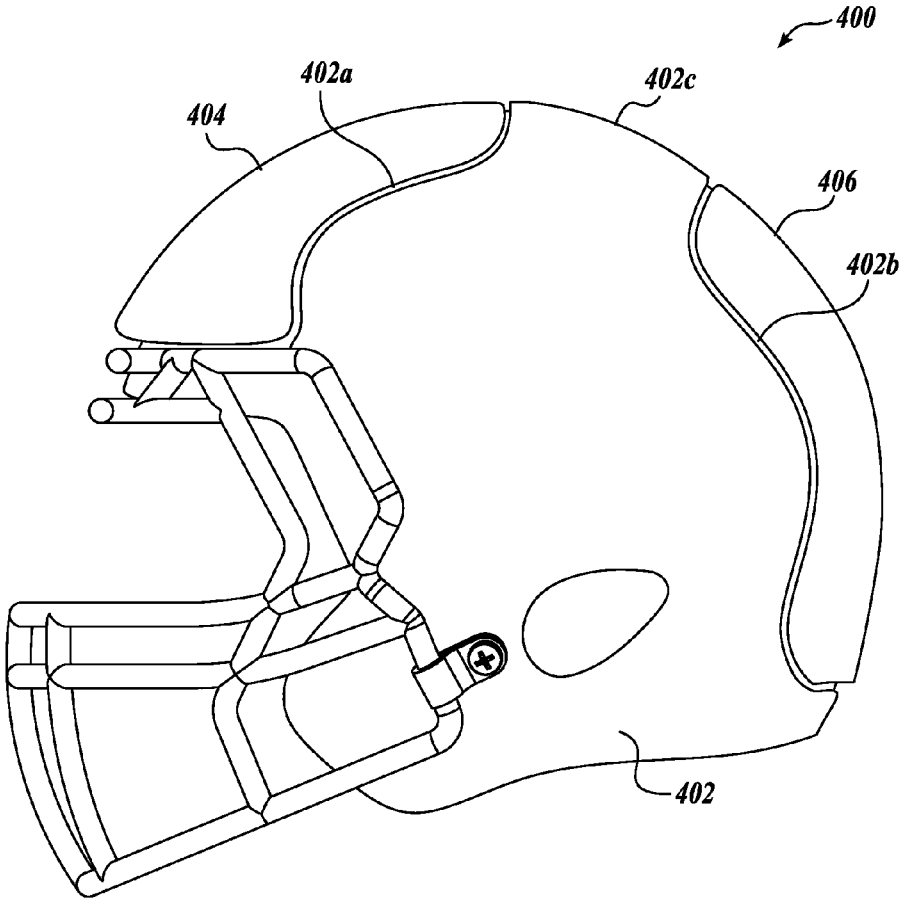

Views of the design of the protective helmet 400 are depicted in FIGS. 5A to 5F. More specifically, FIG. 5A depicts a perspective view of the protective helmet 400; FIGS. 5B and 5C depict a front view and a back view, respectively, of the protective helmet 400; FIGS. 5D and 5E depict a top view and a bottom view, respectively, of the protective helmet 400; and FIG. 5F depicts a side view of the protective helmet 400. In particular, the views in FIGS. 5A to 5F depict how the helmet 400 has a smooth contour between the first and second outer impact shells 404 and 406 and the portions of the primary inner shell 402 other than the depressed crown portion and the depressed rear portion.

Although the embodiments of protective helmets disclosed herein are illustrated as a football helmets, it is to be understood that the protective helmets disclosed herein can be used for any other sport or activity where a helmet is used for impact protection.

While various embodiments of the disclosed subject matter has been illustrated and described, it will be appreciated that various changes can be made therein without departing from the spirit and scope of the claimed invention.

The embodiments of the invention in which an exclusive property or privilege is claimed are defined as follows:

1. A helmet, comprising:

a primary inner shell configured to be worn on a user's head, the primary inner shell comprising a crown portion and a rear portion;

a first outer impact shell having a first end and a second end, the first end of the first outer impact shell being hingedly secured to the primary inner shell, the second end of the first outer impact shell being coupled to the primary inner shell by at least one first shock absorber, wherein the first outer impact shell is located above the crown portion of the primary inner shell, and wherein the at least one first shock absorber is configured to resist rotational movement of the first outer impact shell toward the crown portion of the primary inner shell; and a second outer impact shell having a first end and a second end, the first end of the second outer impact shell being hingedly secured to the primary inner shell, the second end of the second outer impact shell being coupled to the primary inner shell by at least one second shock absorber, wherein the second outer impact shell is located above the rear portion of the primary inner shell, and wherein the at least one second shock absorber is configured to resist rotational movement of the second outer impact shell toward the rear portion of the primary inner shell.

2. The helmet of claim 1, wherein the at least one first shock absorber comprises two piston and cylinder shock absorbers, wherein each of the two piston and cylinder shock absorbers is fastened to the second end of the first outer impact shell, passes through the primary inner shell, and is fastened to an inner side of the primary inner shell.

3. The helmet of claim 2, wherein the at least one second shock absorber comprises two piston and cylinder shock absorbers, wherein each of the two piston and cylinder shock absorbers is fastened to the second end of the second outer impact shell, passes through the primary inner shell, and is fastened to an inner side of the primary inner shell.

4. The helmet of claim 1, wherein the at least one first shock absorber comprises at least one compression spring located between an outer side of the primary inner shell and the first outer impact shell.

5. The helmet of claim 1, wherein the at least one first shock absorber comprises at least one leaf spring located between an outer side of the primary inner shell and the first outer impact shell.

6. The helmet of claim 1, wherein the at least one first shock absorber comprises at least one low profile piston and cylinder located between an outer side of the primary inner shell and the first outer impact shell.

7. The helmet of claim 1, wherein the first end of the first outer impact shell is hingedly secured to the primary inner shell via a first rotational mount, and wherein the first end of the second outer impact shell is hingedly secured to the primary inner shell via a second rotational mount.

8. The helmet of claim 7, wherein axes of the first and second rotational mounts are parallel to each other and tangential to the primary inner shell.

9. The helmet of claim 1, wherein the first outer impact shell is located in a depressed crown portion of the primary inner shell and wherein the second outer impact shell is located in a depressed rear portion of the primary inner shell.

10. The helmet of claim 9, wherein the helmet has a smooth contour between the first and second outer impact shells and the portions of the primary inner shell other than the depressed crown portion and the depressed rear portion.

11. The helmet of claim 9, wherein at least one of the first and second outer impact shells is hingedly secured to the primary inner shell via an axle rotational mount.

12. The helmet of claim 9, wherein at least one of the first and second outer impact shells is hingedly secured to the primary inner shell via a removable rotational mount.

13. The helmet of claim 9, wherein the first and second outer impact shells are configured to rotate independently of each other.

14. A helmet, comprising:

a primary inner shell configured to be worn on a user's head, the primary inner shell comprising a depressed crown portion;

an outer impact shell located in the depressed crown portion of the primary inner shell, wherein the outer impact shell has a first end and a second end, the first end of the outer impact shell being hingedly secured to the primary inner shell; and at least one shock absorber coupled to the second end of the outer impact shell and to the primary inner shell, wherein the at least one shock absorber is configured to resist rotational movement of the outer impact shell toward the crown portion of the primary inner shell.

15. The helmet of claim 14, wherein the at least one first shock absorber comprises two shock absorbers.

16. The helmet of claim 15, wherein two shock absorbers are piston and cylinder shock absorbers, and wherein each of the two piston and cylinder shock absorbers is fastened to the second end of the outer impact shell, passes through the primary inner shell, and is fastened to an inner side of the primary inner shell.

17. The helmet of claim 14, wherein the at least one first shock absorber comprises one or more of a compression spring shock absorber located between an outer side of the primary inner shell and the outer impact shell, a leaf spring shock absorber located between an outer side of the primary inner shell and the outer impact shell, a low-profile piston and cylinder located between an outer side of the primary inner shell and the outer impact shell, a pneumatic bladder located between an outer side of the primary inner shell and the outer impact shell, or a cushioning pad located between an outer side of the primary inner shell and the outer impact shell.

18. A helmet, comprising:

a primary inner shell configured to be worn on a user's head, the primary inner shell comprising a depressed rear portion;

an outer impact shell located in the depressed rear portion of the primary inner shell, wherein the outer impact shell has a first end and a second end, the first end of the outer impact shell being hingedly secured to the primary inner shell; and at least one shock absorber coupled to the second end of the outer impact shell and to the primary inner shell, wherein the at least one shock absorber is configured to resist rotational movement of the outer impact shell toward the rear portion of the primary inner shell.

19. The helmet of claim 18, wherein the at least one first shock absorber comprises two shock absorbers.

20. The helmet of claim 19, wherein two shock absorbers are piston and cylinder shock absorbers, and wherein each of the two piston and cylinder shock absorbers is fastened to the second end of the outer impact shell, passes through the primary inner shell, and is fastened to an inner side of the primary inner shell.

21. The helmet of claim 18, wherein the at least one first shock absorber comprises one or more of a compression spring shock absorber located between an outer side of the primary inner shell and the outer impact shell, a leaf spring shock absorber located between an outer side of the primary inner shell and the outer impact shell, a low-profile piston and cylinder located between an outer side of the primary inner shell and the outer impact shell, a pneumatic bladder located between an outer side of the primary inner shell and the outer impact shell, or a cushioning pad located between an outer side of the primary inner shell and the outer impact shell.

* * * * *